United States Patent [19]

Schroder et al.

[11] Patent Number: 4,563,271

[45] Date of Patent: Jan. 7, 1986

[54] PERCUSSION JIG

[75] Inventors: Norbert Schroder, Oelde; Günter Milewski; Manfred Neusser, both of Ennigerloh; Hermann Dorr, Mulheim an der Ruhr; Armin Supp, Essen; Heinz Rasch, Oelde; Otto Heinemann, Ennigerloh; Heinz-Dieter Baldus, Ahlen; Harald Manthey, Mulheim, all of Fed. Rep. of Germany

[73] Assignee: Krupp Polysius AG, Beckum, Fed. Rep. of Germany

[21] Appl. No.: 615,559

[22] Filed: May 31, 1984

[30] Foreign Application Priority Data

Jun. 20, 1983 [DE] Fed. Rep. of Germany ..... 3322138
Jun. 20, 1983 [DE] Fed. Rep. of Germany ..... 3322137

[51] Int. Cl.[4] ..... B03B 5/24

[52] U.S. Cl. ..... 209/427; 209/491; 209/496; 209/503; 209/504; 209/489; 209/508

[58] Field of Search ..... 364/500–502, 364/162; 308/5 R, 3 R, 3 A; 209/491, 496, 489, 504, 423–427, 485, 486, 503, 508, 446, 449

[56] References Cited

U.S. PATENT DOCUMENTS

| | | | |
|---|---|---|---|
| 1,505,738 | 8/1924 | Stebbins | 209/504 |
| 1,910,386 | 5/1933 | Garrett | 209/425 |
| 2,106,290 | 1/1938 | Akins | 209/504 |
| 2,134,154 | 10/1938 | Smith | 209/504 |
| 2,348,928 | 5/1944 | Sampatacos | 308/73 |
| 3,583,774 | 6/1971 | Gast | 308/5 |
| 3,981,799 | 9/1976 | Jedo | 209/496 |
| 4,148,723 | 4/1979 | Mozley | 209/211 |
| 4,250,543 | 2/1981 | Smith et al. | 364/162 |
| 4,265,744 | 5/1981 | Weiffen | 209/491 |
| 4,308,775 | 1/1982 | Schröder | 83/289 |

FOREIGN PATENT DOCUMENTS

| | | | |
|---|---|---|---|
| 570200 | 1/1933 | Fed. Rep. of Germany | 384/26 |
| 1007232 | 5/1952 | France | 384/13 |

*Primary Examiner*—Frank W. Lutter
*Assistant Examiner*—Wm. Bond
*Attorney, Agent, or Firm*—Learman & McCulloch

[57] ABSTRACT

The invention relates to a percussion jig in which the carrier for material to be separated is freely suspended in the region of its centroidal axis on the piston rod of a hydraulic drive cylinder. This results in a particularly simple construction subject to little wear.

9 Claims, 12 Drawing Figures

PERCUSSION JIG

The invention relates to a percussion jig of the kind having a carrier for material to be separated and which is reciprocable in a settling tub.

BACKGROUND OF THE INVENTION

In a known percussion jig of the general class to which the invention relates the carrier for material to be separated is pivotally mounted at one end in the settling tub. The pivotal movement of the material carrier about the mounting point is achieved by means of a hydraulic or pneumatic drive cylinder which engages on the other end of the material carrier. A jig of this kind is disclosed in German Offenlegungschrift No. 31 15 247.

A significant disadvantage of this known percussion jig resides in the considerable wear to which the pivot mounting point of the material carrier is subjected during on It has a further drawback in that any maintenance and repair work necessary at the mounting point is awkward to carry out and requires the percussion jig to be shut down for long periods.

The objects of the invention, therefore, are to avoid these disadvantages and to provide a percussion jig in which very little wear is produced on the moving parts in operation and any necessary maintenance work can be carried out easily and without long periods of disuse.

SUMMARY OF THE INVENTION

The material carrier of a percussion jig according to the invention is freely suspended in the region of its centroidal axis on a piston rod forming part of the hydraulic drive cylinder. There thus is no need for a separate pivot mounting point for the material carrier in the settling tub. As a result the construction of the percussion jig not only is significantly simplified, but at the same time the wear which occurs of necessity at such a pivot mounting point during operation is avoided.

In operation the freely suspended material carrier of the percussion jig according to the invention moves to and fro in a straight line in the vertical direction and therefore the material carrier can be guided by simple structural means.

THE DRAWINGS

Advantageous embodiments of the invention are illustrated in the accompanying drawings, wherein.

DETAILED DESCRIPTION

The percussion jig illustrated in FIGS. 1 and 2 contains two settlement sections 1, 2 which are of identical construction and consequently only the construction of the settlement section 1 is explained in greater detail below.

Figure 4:
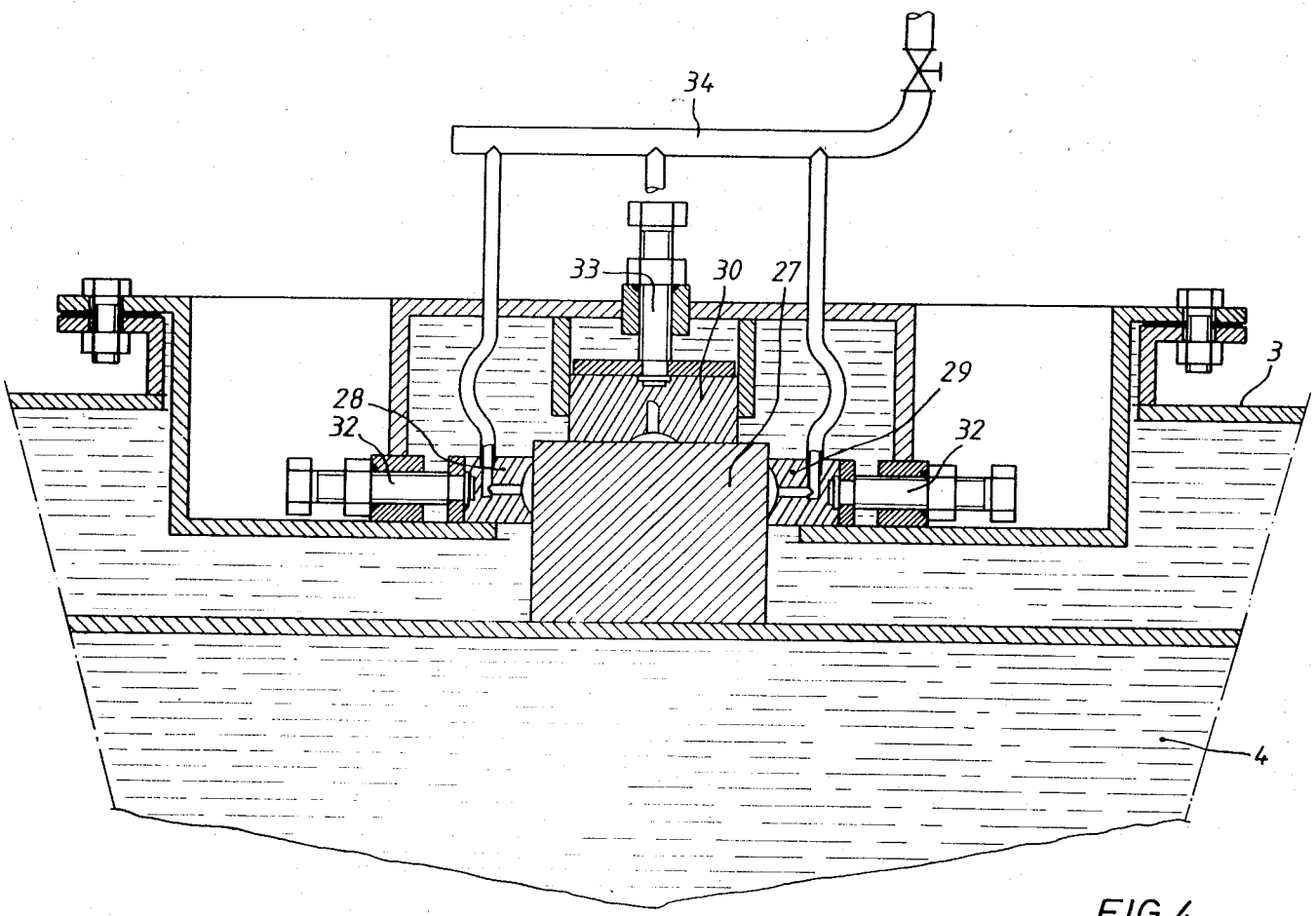
FIG. 4 is a section along the line IV—IV of FIG. 2 and on an enlarged scale.
Figure 5:
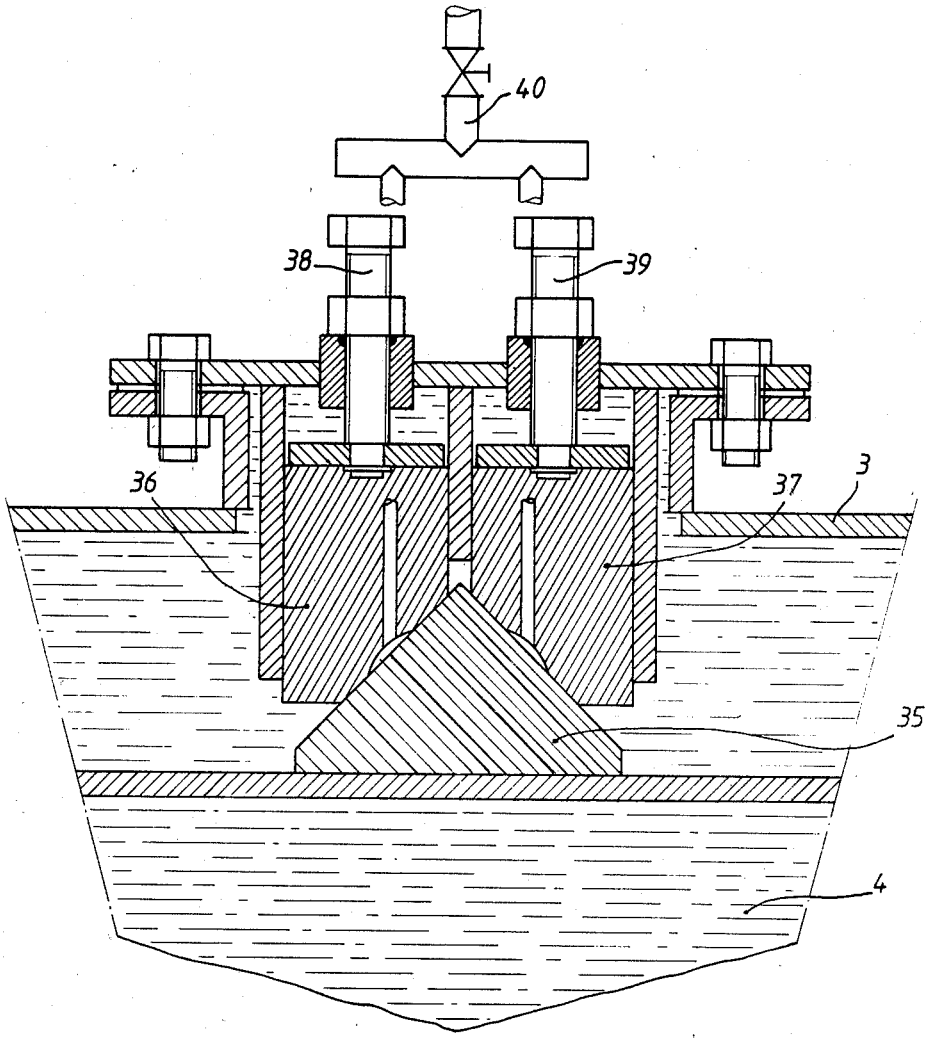
FIG. 5 is a view similar corresponding to FIG. 4 through a further embodiment.

A carrier 4 for material to be separated is movable in the vertical direction in the stationary settling tub 3 which is filled with water and forms the settlement section 1. The material carrier 4 contains side walls 5 and 6 as well as a separating screen 7 and is connected to the piston rod 9 of a double-acting hydraulic cylinder 10 by means of a central column 8 arranged in the region of its centroidal axis. The material carrier 4 and the parts supported thereon are reciprocated in a vertical direction (double headed arrow 11) by the hydraulic cylinder 10. Guide units 12, 13 which are explained in greater detail with reference to FIGS. 4 and 5 are provided to guide the material carrier within the settling tub 3.

A discharge gate 14 which can be actuated by a separate hydraulic cylinder 15 via a lever bar 16 is mounted on the material carrier 4. When the material carrier 4 is moved vertically the discharge gate 14 is moved with it so that the discharge aperture 17 between the material carrier 4 and the discharge gate 14 remains constant.

A material supply hopper through which the material to be separated is delivered to the settlement section 1 is designated by 18. A plurality of pipes 19 are provided in the settlement sections 1 and 2 for the supply of bottom water. An outlet shaft 20 in which an overflow pipe 21 is also arranged is connected to the settlement section 2.

Figure 1:
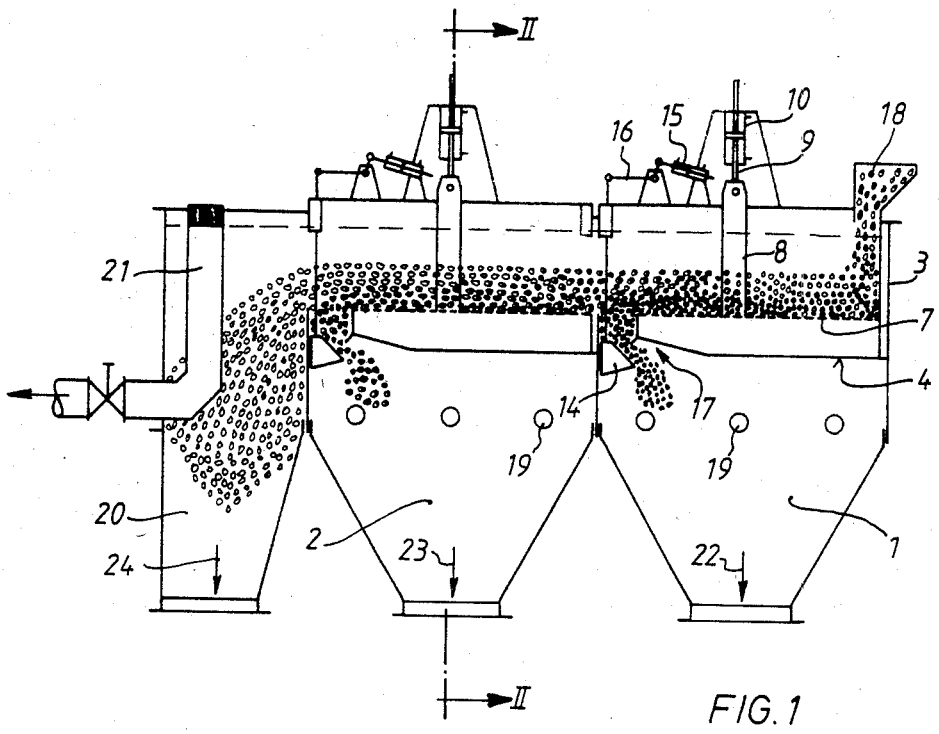
FIG. 1 is a diagrammatic elevational view of a percussion jig having two settlement sections.
Figure 2:
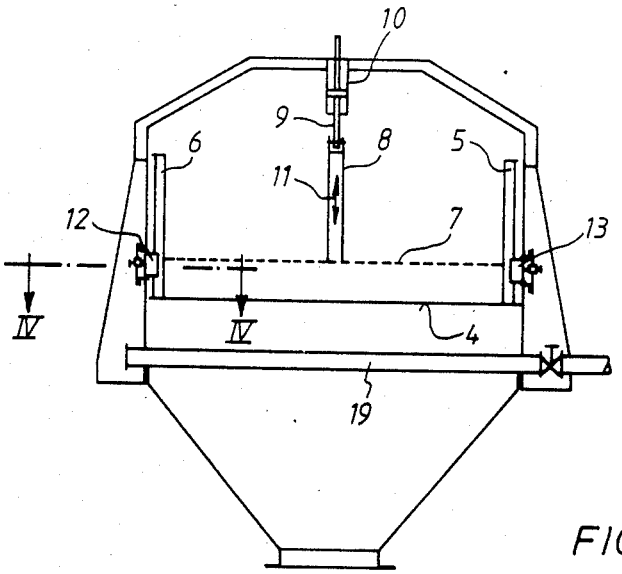
FIG. 2 is a section along the line II—II of FIG. 1.

In the percussion jig illustrated in FIGS. 1 and 2 three different products are extracted (arrows 22, 23, 24) through the settlement sections 1 and 2 and through the outlet shaft 20. It is possible, however, for more than two settlement sections to be arranged one behind the other.

Figure 3:
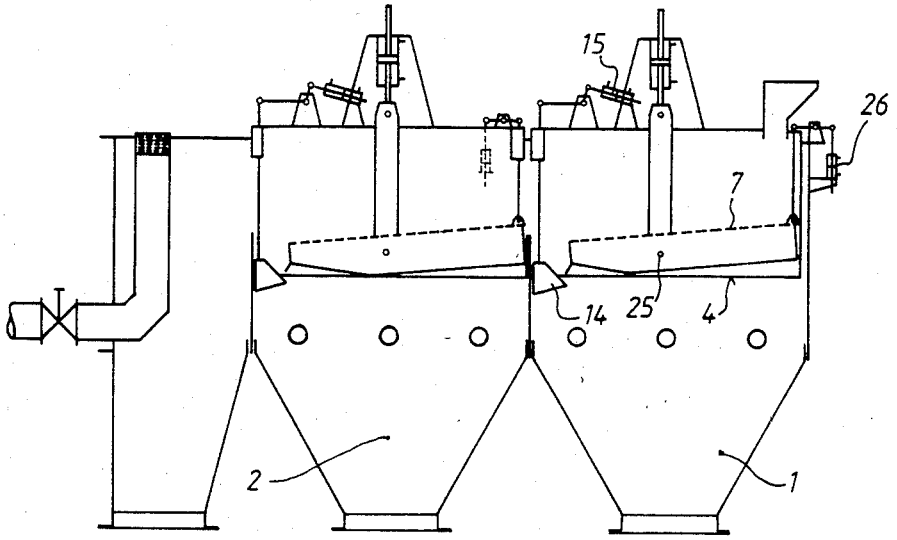
FIG. 3 is a view similar to FIG. 1, but illustrating a variant.

In the variant illustrated in FIG. 3 the separating screen 7 is supported on an axis 25 so as to be pivotable on the material carrier 4. The inclination of the separating screen 7 relative to the material carrier 4 can be adjusted by means of a separate hydraulic cylinder 26. Like the discharge gate 14 and the hydraulic cylinder 15 which serves to move such discharge gate, the hydraulic cylinder 26 is mounted on the vertically movable material carrier 4 and is movable with the latter. Otherwise, the embodiment according to FIG. 3 corresponds to the arrangement according to FIGS. 1 and 2.

FIG. 4 shows an embodiment of the guide units 12, 13 (FIG. 2) which serves for vertical guiding of the material carrier 4 relative to the stationary settling tub 3.

A guide rail 27 is mounted in the region of each of the two guide units 12 and 13 on the periphery of the material carrier 4 and is in sliding contact with three slide parts 28, 29, 30 which are arranged in the settling tub 3 and can be adjusted from the exterior by means of setscrews 32, 33. A washing water supply 34 is connected to channels provided in the slide parts 28, 29, 30 and supplies washing water to the sliding surface between the guide rail 27 and the slide parts 28, 29, 30. In operation the material carrier 4 which is freely suspended in its centroidal axis moves in a vertical direction (i.e., perpendicular to the drawing plane of FIG. 4) and is satisfactorily guided in the region of the two guide units 12, 13 (FIG. 2) by the guide rail 27 and the slide parts 28, 29, 30.

In the embodiment according to FIG. 5 a guide rail 35 of triangular cross-section is provided in the region of the two guide units 12, 13 (FIG. 2) on the periphery of the material carrier 4 and is in sliding contact with two slide parts 36,37 which are arranged on the inner periphery of the settling tub 3 and are adjustable from the exterior by means of setscrews 38, 39. Here too a washing water supply 40 is connected to the channels provided in the slide parts 36, 37. The way in which this guiding arrangement operates during the movement of the material carrier 4 perpendicular to the drawing plane of FIG. 5 should be readily understood.

Figure 6:
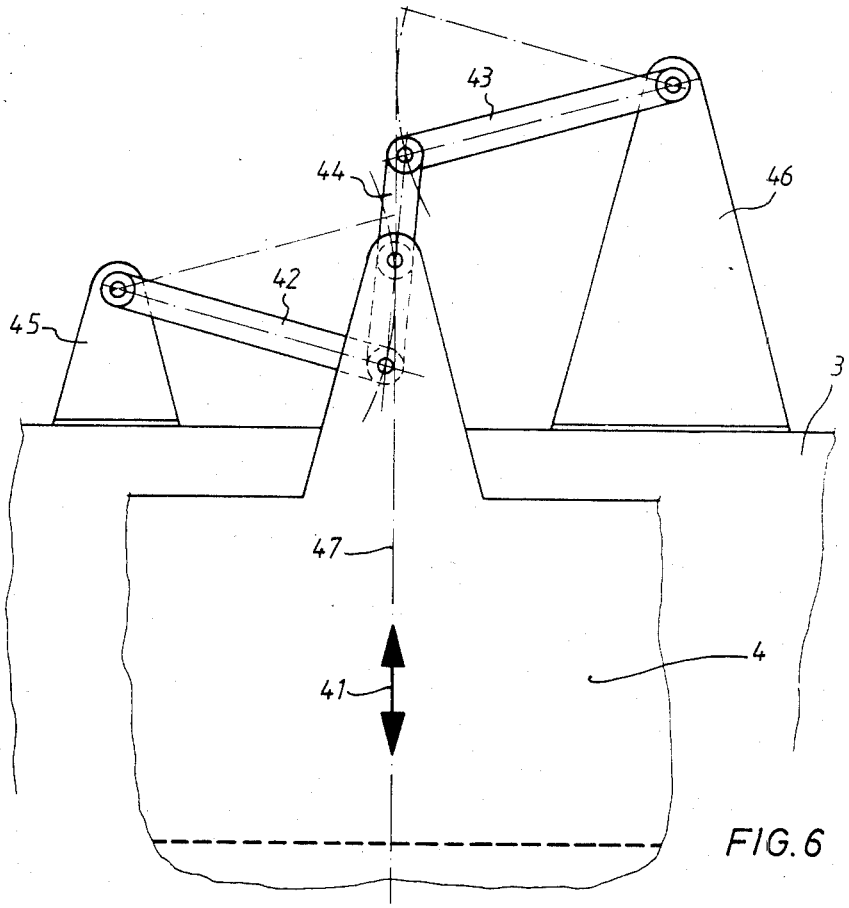
FIG. 6 is a vertical partial view on an enlarged scale of a modified form of the apparatus for vertical guiding of the material carrier.

FIG. 6 shows a further embodiment of guiding means for the material carrier 4 in its vertical movement (double headed arrow 41) in the settling tub 3. The settling tub 3 is provided in the region of each of its two side walls (i.e., adjacent to the side walls 5 and 6 of the material carrier 4, see FIG. 2) with a guide lever system consisting of two control levers 42, 43 and an intermediate lever 44. The levers 42, 43 have one end pivoted on holders 45, 46 and their other ends pivoted on the intermediate lever 44 which, in turn, is pivoted at its center on the material carrier 4. As can be seen from FIG. 6, during the vertical movement of the material carrier 4 the guide lever system formed by the levers 42, 43 and 44 holds the central plane 47 of the material carrier 4 in the illustrated position, i.e. in the same vertical plane in which (in the region of the centroidal axis of the material carrier 4) the piston rod 9 of the hydraulic drive cylinder 10 engages.

With the aid of FIGS. 7 to 12 an embodiment of the percussion jig according to the invention is explained in which an electronically controlled hydraulic drive construction having an adjustable stroke diagram is provided.

Exhaustive experiments by the inventors with synthetic mixtures of coal and quartz sand and with natural rawfine coal showed that there is no single optimum diagram of the lifting and lowering movement for the successive separating processes in a percussion jig. On the contrary, the diagram must be adapted to the conditions in the machine which vary from delivery to discharge.

FIGS. 7 to 10 show four idealized theoretical basic forms of the stroke diagram in which the stroke height (mm) is plotted in the ordinate and the time (sec) in the abscissa.

Figure 7:
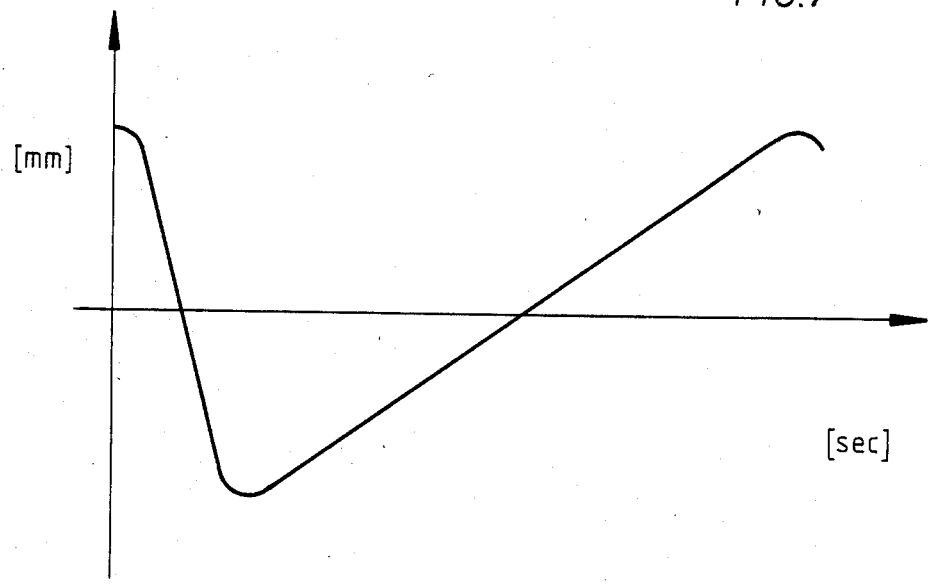
FIGS. 7–11 illustrate various stroke diagrams.
Figure 8:
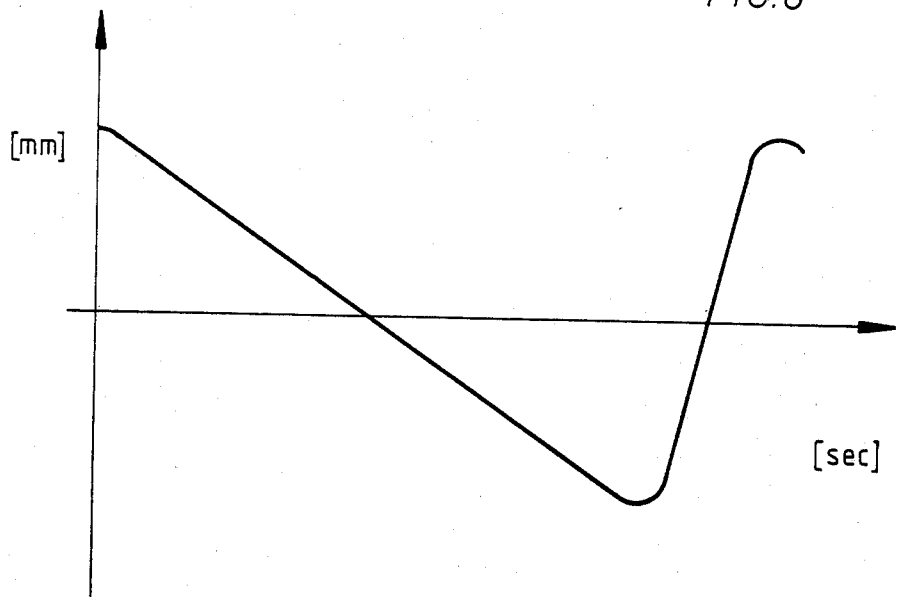

The stroke diagram according to FIG. 7 includes a rapid downward movement with constant speed and a slow upward movement with equally constant speed. In FIG. 8 the conditions are reversed.

Figure 9:
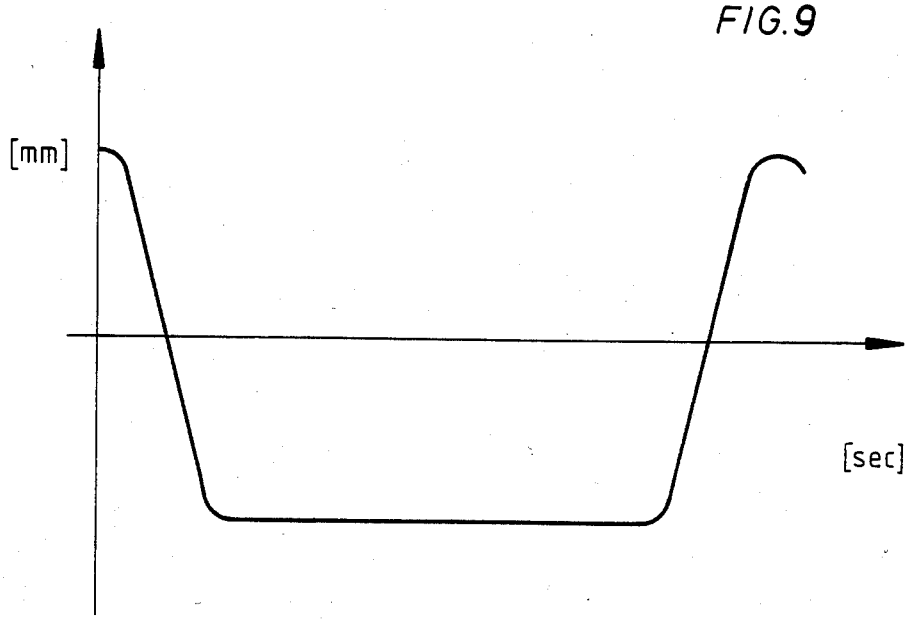

FIG. 9 shows a trapezoidal stroke diagram with a rapid constant downward speed, a certain holding period and a rapid constant upward speed.

Figure 10:
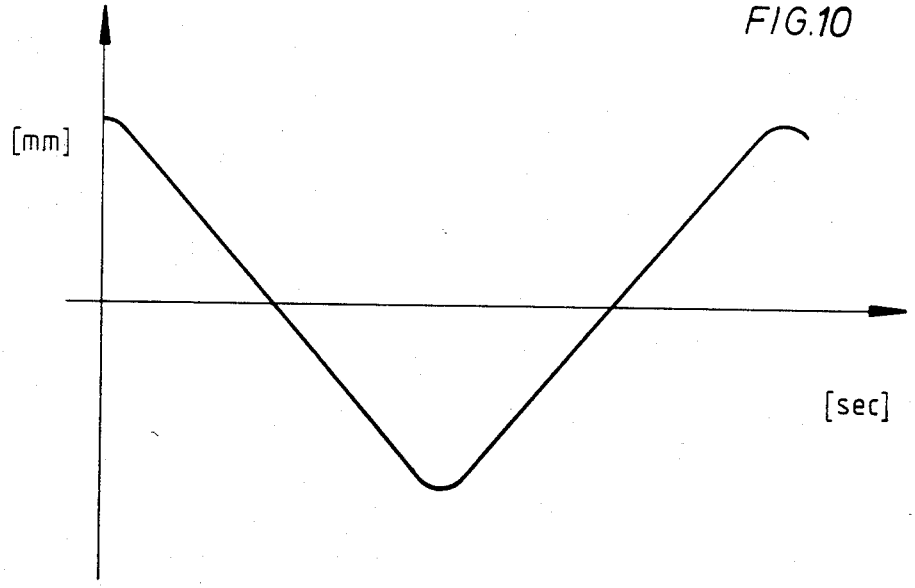

FIG. 10 shows a stroke diagram with equal upward and downward speed.

In the exhaustive experiments referred to above it also proved significant that the loosening of the material to be separated which is necessary for the settlement process can be improved by superimposing a higher-frequency harmonic vibration on a basic movement path. This results in improved loosening of the material above all in the region closely surrounding the individual grains of the granular mixture to be separated.

Figure 11:
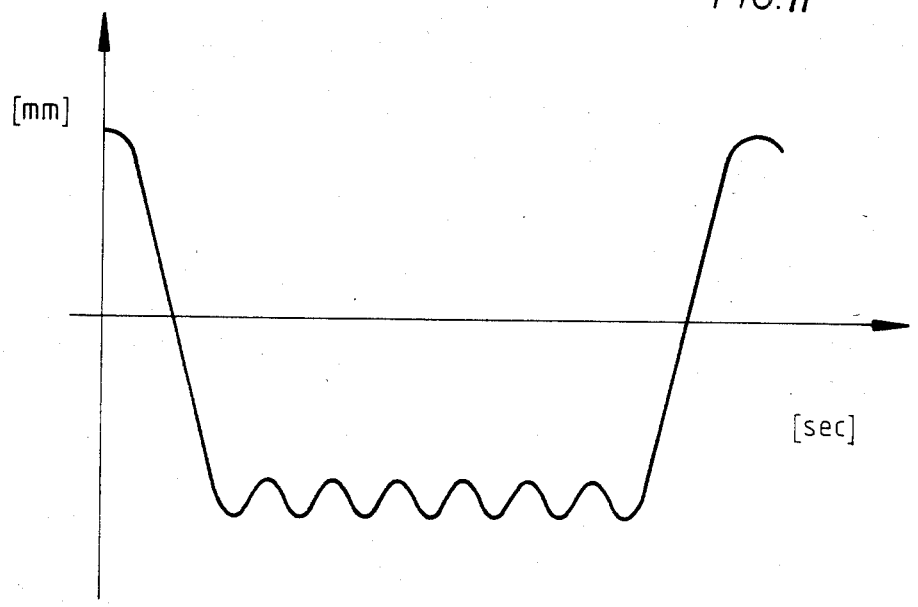

FIG. 11 shows such a stroke diagram in which a higher-frequency harmonic vibration is superimposed on the trapezoidal basic diagram of FIG. 9 in the range of the holding period.

Figure 12:
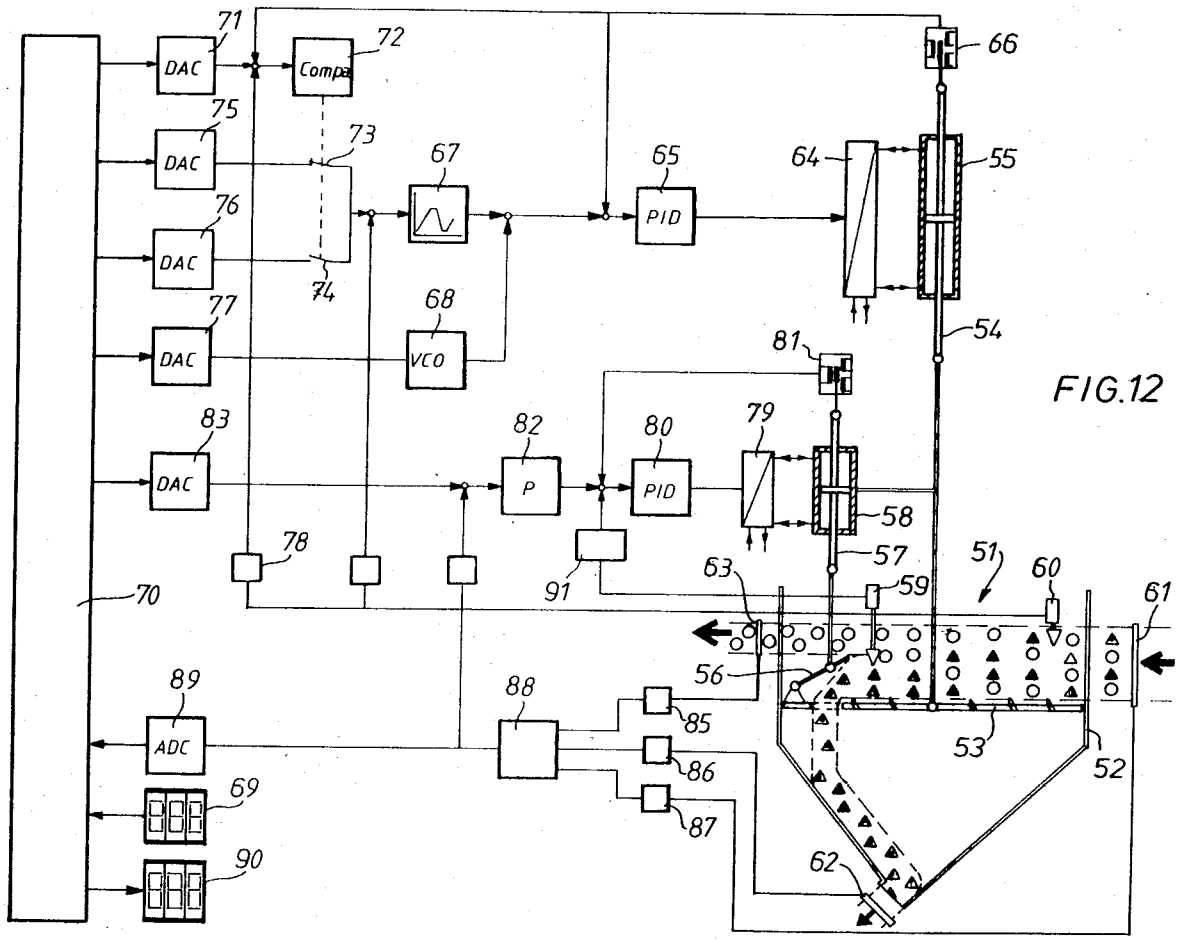
FIG. 12 is a block wiring an diagram of an electronic control for a percussion jig.

FIG. 12 shows an embodiment of the percussion jig according to the invention with which any selected stroke diagrams can be achieved.

The illustrated percussion jig 51 contains a settling tub 52 filled with water and a material carrier which is moved mechanically in the settling tub 52 and has a separating screen 53. The material carrier with the separating screen 53 is connected to the piston rod 54 of a double-acting hydraulic cylinder 55 which forms an electronically controlled hydraulic drive means for the material carrier.

Connected to the moving material carrier is a discharge gate 56 which is connected to the piston rod 57 of a double-acting hydraulic cylinder 58 which is moved upwards and downwards with the material carrier by the piston rod 54 of the hydraulic cylinder 55.

The percussion jig 51 also contains two floats 59 and 60 as well as samplers 61, 62, 63 in the region of the material supply, the material extractions from the illustrated first settling tank, and from the region of the junction with a following settling tank which is not illustrated.

The double-acting hydraulic cylinder 55 is controlled via a proportional valve 64 by a PID controller 65 which is connected to a setting means and a displacement pickup 66 connected to the piston of the hydraulic cylinder 55 in order to form a closed position control circuit. The setting means is formed by a curve creator 67 and a voltage-controlled oscillator 68 the outputs of which are connected to the theoretical value input of the PID controller 65.

Thus the path of the piston of the hydraulic cylinder 55 follows the theoretical value which is variable with time according to the chosen stroke diagram. The movement of the working piston can be put together synthetically as regards the upward stroke, the holding period, the downward stroke, and any sinusoidal superimposition (according to frequency and amplitude).

The theoretical values are fed into a computer 70 via a keyboard 69. There could be a choice, for example, of two different input modes. In a first mode (stroke regulation) the theoretical values for the number of strokes (strokes per minute), the upward and downward speed (mm/s), the holding period (s) and the heterodyne frequency are fed into the computer 70 via the keyboard 69. From such values the computer calculates the theoretical value for the stroke height and passes this value via a digital-analog converter 71 to a comparator 72.

This compares the theoretical value with the actual value of the stroke and ends the selected movement by means of switches 73, 74. The theoretical value for the stroke movement is frozen, i.e., held at the value at the moment of stopping, until all parallel-running settling tank drives (of several settling tanks) are synchronized and the holding period has expired. In this way absolute parallel running of a plurality of settling tanks is ensured in continuous operation.

The theoretical values for the upward and downward speed stored in the digital-analog converters 75, 76 are displayed in absolute terms in mm/s by LED displays.

After the theoretical values for the number of strokes and the holding period have been fed to the computer, the calculated stroke (mm) is displayed by the converter 71. The same applies to the stroke height of parallel-running settling tanks. The digital-analog converter 77 supplies the oscillator 68 which produces the higher-frequency heterodyne oscillation. The stroke height can be altered as a function of the height of the layer measured by the float 60 so that the stroke is optimized automatically by the height of the layer.

In a second possible mode (frequency regulation) the theoretical values for the stroke, the upward and downward speed, the heterodyne frequency and the holding period are predetermined. The number of strokes is calculated from the theoretical values.

As with the stroke regulation, in the case of frequency regulation too the automatic optimization of the stroke height as a function of the height of the layer is possible. The proportional factor can be set on a control element 78.

Finally the discharge regulation should be explained. It serves the purpose of supplying the materials separated by the settlement process to different outlets.

The control element is the discharge gate 56 which has already been mentioned above and is connected to the piston of the double-acting hydraulic cylinder 58. This cylinder 58 is controlled via a proportional valve 79 by a PID controller 80 which is connected to the float 59 which acts as the setting means and to a displacement pickup 81 connected to the piston of the hydraulic cylinder 58 in order to form a closed position control circuit. The float 59 is set so that it is heavier than the upper material layer and lighter than the lower material layer.

A minimum value storage unit 91 is connected to the float 59 and ensures that only the float signal measured in the jigged state of the settling tank is used for discharge regulation since the measurement values obtained during the jigging and settlement periods are not representative.

The position control circuit can be led through a superimposed cascade which contains an amplifier 82 and a digital-analog converter 83 and uses the ratio of the specific gravities of the two materials to be separated as the standard size.

The optimum degree of separation is achieved when this ratio is a maximum. However, this presupposes the taking, preparation, and evaluation of samples. Sample sample processing apparatus 85, 86,.87, sample analysis apparatus 88, and an analog-digital converter 89 serve for this.

In any case it is possible to move the cross-section by means of a theoretical value correction when this is necessary on the basis of manual samples. By means of a keyboard 90 a correction value is passed via the converter 83 to the regulator 80.

We claim:

1. A percussion jig comprising a settling tub having an inlet end and an outlet end adapted to contain a quantity of liquid; a carrier within said tub adapted to support material to be separated; reciprocable drive means coupled to said carrier in the region of the latter's centroidal vertical axis for reciprocating said carrier vertically relatively to said tub; cooperable guide means coupling said tub and said carrier for guiding the latter vertically with respect to the former; a quadrangular screen means for supporting said material to be separated and mounted on said carrier for adjustment of the inclination of said screen means relative to the horizontal; and adjustment means coupled to said screen means for adjusting its said inclination to a selected position of adjustment relative to the carrier.

2. A jig according to 1 including a movable discharge gate mounted on the carrier, and including means coupled to said gate for moving the latter between selected open and closed positions.

3. A jig according to claim 1 wherein said guide means include guide rails on the material carrier and slide parts on the tub in sliding engagement with the guide rails.

4. A jig according to claim 3 including adjusting means connected to said slide parts and operable from the exterior of said tub to adjust said slide parts relatively to said guide rail.

5. A jig according to claim 1 wherein the guide means for said carrier includes a pair of control levers each of which is pivoted at one end to said tub and at its other end to an intermediate lever which is pivoted at its center to the material carrier.

6. A jig according to claim 1 wherein said drive means comprises a pressure fluid ram operable to move said carrier according to a selected one of a number of different stroke paths, and including electronic control means coupled to said ram for controlling the latter.

7. A jig according to claim 6 wherein said ram comprises a double-acting cylinder having a movable piston controlled via a proportional valve by a PID controller connected to a setting means and a displacement pickup connected to the piston of the cylinder to form a closed position control circuit.

8. A jig according to claim 7 wherein the setting means is formed by a curve creator and a voltage-controlled oscillator the outputs of which are connected to the theoretical value input of the PID controller.

9. A jig according to claim 6 including a movable discharge gate supported on the material carrier, and a second double-acting cylinder having a piston connected to said gate, said second cylinder being connected to the material carrier for movement therewith, the piston of said second cylinder being controlled via a proportional valve by a PID controller connected to a float acting as a setting means and a displacement pickup connected to the piston of said second cylinder to form a closed position regulating circuit.

* * * * *